US005687964A

United States Patent [19]

Stephan et al.

[11] Patent Number: 5,687,964

[45] Date of Patent: Nov. 18, 1997

[54] DEVICE FOR CONTACTLESS GUIDANCE OF SHEETLIKE MATERIAL

[75] Inventors: Günter Stephan, Wiesloch-Baiertal; Richard Mack, Brühl; Peter Thoma; Joachim Herrmann, both of Mannheim; Gerd Raasch, Sandhausen; Michael Szeidl, Bammental; Jürgen Zeltner, Hirschberg, all of Germany

[73] Assignee: Heidelberger Druckmaschinen AG, Heidelberg, Germany

[21] Appl. No.: 510,977

[22] Filed: Aug. 3, 1995

[30] Foreign Application Priority Data

Aug. 3, 1994 [DE] Germany ..... 44 27 448.3

[51] Int. Cl.[6] ..... B65H 29/24

[52] U.S. Cl. ..... 271/195

[58] Field of Search ..... 271/195, 211, 271/276, 97, 3.22, 3.23

[56] References Cited

U.S. PATENT DOCUMENTS

| | | |
|---|---|---|
| 3,633,281 | 1/1972 | Vits . |
| 5,102,118 | 4/1992 | Vits . |
| 5,222,726 | 6/1993 | Vits . |

FOREIGN PATENT DOCUMENTS

| | | | |
|---|---|---|---|
| 789419 | 7/1968 | Canada | 271/195 |
| 19 07 083 | 12/1975 | Germany . | |
| 36 29 720 | 4/1987 | Germany . | |
| 38 41 909 | 10/1989 | Germany . | |
| 89 15 626.9 | 4/1991 | Germany . | |
| 41 41 261 | 6/1993 | Germany . | |
| 2226538 | 7/1990 | United Kingdom | 271/195 |
| 2276150 | 9/1994 | United Kingdom | 271/195 |

*Primary Examiner*—David H. Bollinger

*Attorney, Agent, or Firm*—Herbert L. Lerner; Laurence A. Greenberg

[57] ABSTRACT

Device for contactless guidance of sheetlike material being dragged along a travel path, the device having a guide surface member extending spaced from the travel path and being provided with air-blowing nozzles, includes a guide zone formed in the guide surface member wherein the air-blowing nozzles are disposed in a manner that a common flow pattern or gap flow formed during guidance of the sheetlike material is determined essentially by a first velocity component in a direction of motion of the material along the travel path and by a second and a third velocity component directed towards two side edges, respectively, of the travel path, the second velocity component being associated with one of the side edges and the third velocity component being associated with the other of the side edge.

34 Claims, 16 Drawing Sheets

DEVICE FOR CONTACTLESS GUIDANCE OF SHEETLIKE MATERIAL

BACKGROUND OF THE INVENTION

1. Field of the Invention

The invention relates to a device for contactless guidance of sheetlike material, in particular through a printing press, preferably a sheet-fed printing press, wherein the material is dragged along a travel path, the contactless guidance device having a guide surface member extending spaced from the travel path and being provided with air-blowing nozzles.

It has become known heretofore to guide sheetlike material in printing presses along a guide surface member, the sheetlike material being firmly held at the leading edge thereof by a gripper system which drags the material along a specific travel path. The travel path may either be a straight path or a concavely or convexly curved path. Because of centrifugal force and other variables, the dragged sheets tend to flutter, so that contact of the sheet with the guide surface member cannot be precluded. During contact of the sheet with the guide surface member, damage to the sheet can occur, or at least impairment of the print quality, both in one-sided and perfector or recto/verso printing, for example, due to smearing, may result. To prevent such contact of sheets with guide surface members, a proposal has been made heretofore that the sheets be acted upon by flowing air. Both suction and blowing air devices which, respectively, generate a flow of suction or blown air have become known heretofore, the air flow acting upon the respective sheet through openings formed in the guide surface member. While these devices which generate suction and/or blown air can cause the sheet to remain on a specific or predetermined travel path due to the air guidance, nevertheless, freedom from contact with the guide surface member cannot be assured, because the air flows acting perpendicularly to the sheet cannot prevent fluttering of, especially, the end of the sheet. By alternatingly applying suction and blown air to the sheets, smearing of the sheets can occur, especially in the region of the suction air.

From published German Patent Document DE 41 41 261 A1, a device has become known heretofore which has only air-blowing nozzles exclusively, mutually related pairs of these nozzles generating intersecting air flows at a varying outlet or discharge angle, these air flows being applied to a dragged sheet. This special formation of the blown air flow is intended to exert a suction and a bracing or supporting action upon the sheets being conveyed. The nozzles are arranged so that the air blown out of one nozzle is aimed at the outlet opening of the next nozzle. The guiding effect has been found not to be satisfactory, however.

It is therefore an object of the invention to provide a device of the foregoing general type with which contactless guidance of sheetlike material is possible, in a relatively simple and economical manner, regardless of the size and weight of the material, and at various machine speeds in all regions of a processing machine, such as a printing press.

SUMMARY OF THE INVENTION

With the foregoing and other objects in view, there is provided, in accordance with the invention, a device for contactless guidance of sheetlike material being dragged along a travel path, the device having a guide surface member extending spaced from the travel path and being provided with air-blowing nozzles, comprising a guide zone formed in the guide surface member wherein the air-blowing nozzles are disposed in a manner that a common flow pattern or gap flow formed during guidance of the sheetlike material is determined essentially by a first velocity component in a direction of motion of the material along the travel path and by a second and a third velocity component directed towards two side edges, respectively, of the travel path, the second velocity component being associated with one of the side edges and the third velocity component being associated with the other of the side edges.

In accordance with other features of the invention, the second and the third velocity components, respectively, are directed symmetrically to the side edges.

Furthermore, the guide surface member is formed entirely of the guide zone.

The gap flow flares in a trumpetlike manner in the sheet travel direction.

The air-blowing nozzles are disposed in the guide zone in rows offset from one another, transversely to the sheet travel direction.

The air-blowing nozzles of a downstream row thereof, as viewed in the sheet travel direction, are disposed relative to an intersecting location of edges of divergence regions of streams of blown air from two air-blowing nozzles disposed offset from one another.

The air-blowing nozzles are disposed downstream from the intersecting location, as viewed in the sheet travel direction.

The air-blowing nozzles are disposed upstream from the intersecting location, as viewed in the sheet travel direction.

The distance from the intersecting location is at most equal to half the distance by which the upstream air-blowing nozzles are spaced apart from one another.

The air-blowing nozzles are disposed at the intersecting location.

The air-blowing nozzles in the guide zone are formed of first air-blowing nozzles and second air-blowing nozzles, the first air-blowing nozzles being disposed on a center line of the guide surface member extending in the sheet travel direction, so as to direct blown air streams substantially in the sheet travel direction, and the second air-blowing nozzles being disposed in rows offset from one another, extending transversely to the sheet travel direction, so as to direct blown air streams symmetrically to the side edges of the guide surface member.

The blown air streams of the second air-blowing nozzles are directed at an angle of between 0° and 90° with respect to the sheet travel direction, symmetrically towards the side edges of the guide surface member.

The blown air streams of the second air-blowing nozzles are directed towards a gap formed by two of the second air-blowing nozzles disposed downstream in the blowing direction.

The blown air streams of the second air-blowing nozzles are directed substantially towards an air-blowing nozzle disposed downstream in the blowing direction.

The air-blowing nozzles are disposed in a pyramidlike structure on the guide surface member.

The blown air streams of the second air-blowing nozzles are directed substantially towards a second air-blowing nozzle disposed downstream in the blowing direction in a row next-but-one thereto.

The blown air streams of the second air-blowing nozzles are directed substantially transversely to the sheet travel direction.

The guide surface member is formed with an inlet zone preceding the guide zone in the sheet travel direction.

The device of the invention includes an outlet zone downstream of the inlet zone.

The guide surface member is formed with an outlet zone succeeding the guide zone in the sheet travel direction.

The inlet zone is provided with at least one row of air-blowing nozzles acting counter to the sheet travel direction.

The outlet zone is provided with at least one row of air-blowing nozzles acting transversely to the sheet travel direction.

The air-blowing nozzles act symmetrically transversely to the sheet travel direction.

The inlet zone has a rounded portion directed away from the travel path of the material.

The inlet zone and the outlet zone, respectively, have a rounded portion directed away from the travel path of the material.

The outlet zone has a rounded portion directed away from the travel path of the material.

The inlet zone precedes at least one air-blowing nozzle blowing transversely to the sheet.

The guide surface member is formed of at least two sections, each of which has a guide zone, an inlet zone, and/or an outlet zone.

The inlet zone of the guide surface member is formed with recesses at a front end thereof for grippers of a material dragging device.

The device of the invention includes means for supplying blowing air to the guide surface members via a central blower.

The device also includes means for supplying blowing air to the guide surface members via a decentralized blower.

The guide surface members have at least one of viewing windows and control stations assigned thereto, by means of which observation and adjustment, respectively of a guiding effect of the guide surface members is performable.

The viewing windows are disposed in transition regions of the guide surface members.

The device of the invention includes means for exerting influence by way of the control stations upon flow parameters of guiding air furnished by blowers.

Because the guide surface member has air-blowing nozzles disposed and/or oriented in a guide zone in such a way that a common flow pattern (gap flow) developing upon guidance of the sheetlike material is determined essentially by a first velocity component in the direction of motion of the material and by a second and a third velocity component, which are directed towards the two side edges of the travel or movement path, the second velocity component being associated with the one side edge and the third velocity component being associated with the other side edge, it is advantageously possible to afford contactless guidance of the material over the guide surface member. The velocity components of the resultant gap flow between the material and the guide surface member, which are directed towards and preferably symmetrically to the edges of the material, assure the formation of a uniform film of air, on which the material is guided. Fluttering, especially of the trailing edge of the material, is avoided. In a further advantageous feature of the invention, it is provided that the guide surface member has at least two zones in succession in the direction of motion of the material (travel or conveying direction), preferably an inlet zone, a guide zone, and/or an outlet zone, each with a different flow pattern effected by suitable construction and/or disposition of the air flow nozzles. As a result, it is advantageously possible to attain a mutually substantially independent variation of the flow parameters in the successive zones, so that influence can be exerted upon the special flow patterns that are adapted to the various functions of the various zones. In accordance with the progress of motion in the motion direction of the material over the guide surface member, influence can thus be exerted upon various functional requirements. Depending upon the functional requirements, a varying influence of the guidance effect can be accomplished by means of a suitably adapted variation of the various flow patterns. A sheetlike material dragged across the respective guide surface member is thus acted upon by different flow patterns in succession, thereby assuring flutter-free and nonsmearing movement of the material. Even at high machine speeds, guiding air for the sheetlike material can thus be furnished, which brings about contactless guidance along the guide surface member, while at the same time at critical transition locations, at which the sheetlike material and in particular the trailing end of the sheetlike material tends to flutter and thus contact the guide surface members because of centrifugal force, inertia, pressure differences and/or turbulence, a flow pattern that exclusively counteracts these motions is especially present. The combination of the successive zones with different flow patterns should be adapted to one another in such a way that along the guide surface member a total flow pattern is established which results in a flutter-free, contact-free guidance of the sheetlike material, regardless of the machine speed, and regardless of the weight and size of the material itself, without requiring additional supporting and/or auxiliary blower devices.

Other features which are considered as characteristic for the invention are set forth in the appended claims.

Although the invention is illustrated and described herein as embodied in a device for contactless guidance of sheetlike material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
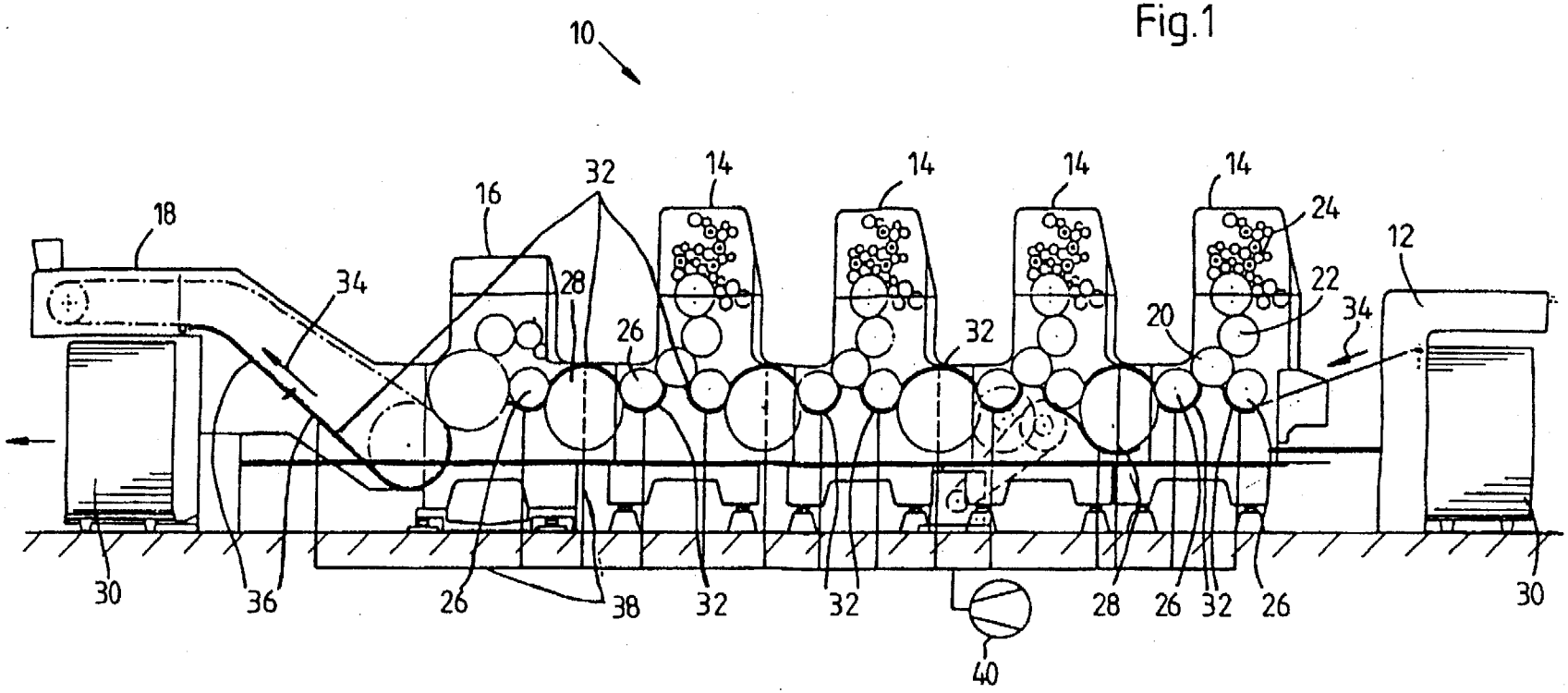
FIG. 1 is a diagrammatic side elevational view of a sheet-fed printing press incorporating the contactless guiding device according to the invention.

Referring now to the drawings and, first, particularly to FIG. 1 thereof, there is diagrammatically shown therein a sheet-fed printing press generally identified by reference numeral 10. The sheet-fed printing press 10 has a feeder 12, one or more printing units 14, four printing units being shown in the embodiment of FIG. 1, a varnishing system 16 and a delivery 18. The printing units 14 include impression cylinders 20, which need not be described in any greater detail here, and other cylinders 22, as well as dampening and inking cylinders 24. Sheet guiding cylinders 26 are disposed between the printing units 14, and turning cylinders 28 may also be provided. Sheet guiding devices referred to herein as guide surface members 32 are disposed along the travel or movement path of sheets 30. The guide surface members 32 may have either a flat shape or a concavely or convexly curved shape, and they are disposed in regions along the travel of the sheets, the objective thereof being that the sheets 30, during transport thereof, do not touch either the guide surface members 32 or any other parts of the sheet-fed printing press 10. The sheets 30 are dragged along the travel path thereof, at a spaced distance from the guide surface members 32, by non-illustrated gripper systems which engage the leading edge of the sheets 30. The guide surface members 32 are disposed between the feeder 12 and the first printing unit 14, between the individual printing units 14 in the vicinity of the sheet guiding cylinder 26 and the turning cylinders 28, and in the delivery 18. The guide surface members 32 may also be combined with further unidentified stretches or lengths of a dryer and feeds to the impression cylinders 20. The guide surface members 32 may be formed as an uninterrupted unit, as viewed in the sheet-feeding direction represented by the arrow 34 or, in other words, the guide surface member is of unipartite or one-piece construction. The uninterrupted guide surface member 32 may also be formed of separate successively disposed segments 36, which are composed or assembled in a manner described hereinafter. FIG. 1 suggests that, by way of example, the guide surface member disposed in the delivery 18 is formed of two segments 36. The guide surface members 32 curved concavely or convexly around the cylinders can likewise be formed of individual segments which then, in turn, form a single uninterrupted guide surface member 32. The various individual guide surface members 32 are connected to a blower 40 via a supply line system 38. During the operation of the sheet-fed printing press 10, the supply line system 38 is supplied by the blower 40 with blowing air, which emerges from air-blowing nozzles disposed on the guide surface members 32 and forms thereat guiding air for the sheets 30.

Figure 2:
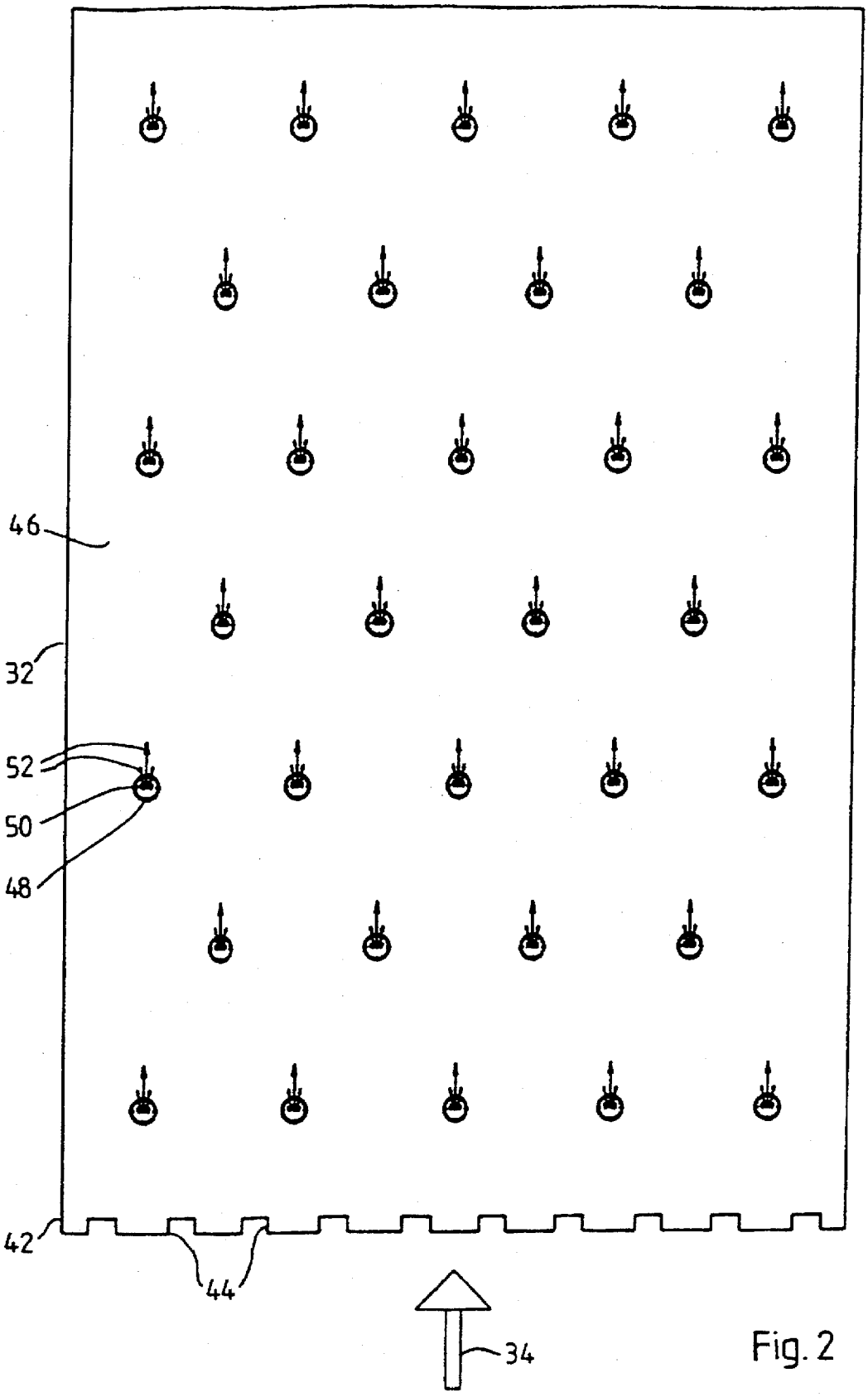
FIG. 2 is a top plan view of a guide surface member of the guiding device of the sheet-fed printing press.

FIG. 2 is a plan view of a guide surface member 32. The guide surface member 32 can have either a flat or a concavely or convexly curved surface or course and is disposed so that it extends substantially parallel to the sheet travel path prescribed by the gripper system. The sheet 30 is dragged by the gripper system along the guide surface member 32, with the intention of avoiding contact therebetween, especially between the guide surface member 32 and the trailing edge of the sheet. The distance of the guide surface members 32 from the gripper system is approximately 5 to 30 mm to prevent collisions between the gripper system and the guide surface member 32. Recesses 44 are formed in a front end 42 of the guide surface member 32, as viewed in the sheet feeding direction 34, and are associated with the individual grippers of the gripper system, so that when those grippers move, they can arrive within range of the guide surface member 32 without colliding therewith. The guide surface members 32 have a smooth surface 46. As noted hereinbefore, they may be formed as a unipartite or one-piece metal sheet, for example, or of individual segments which are disposed transversely to the sheet travel or conveying direction 34 and joined to one another. The individual segments are joined in a manner that the surfaces 46 of the various segments merge flush and in alignment with one another. Air-blowing nozzles 48 are formed in the surface 46 of the guide surface members 32 and communicate with the supply line system 38 for blowing air shown in FIG. 1. All of the air-blowing nozzles 48 of one guide surface member 32 may be connected to the same supply line through a suitable conduit arrangement located below the guide surface members 32. However, it is also possible for the air-blowing nozzles 48 of one guide surface member 32 to be connected in groups to separate supply lines, so that, in particular, a varying application of blowing air may be effected. The air-blowing nozzles 48, respectively, have an air outlet opening 40 from which streams 52 of blowing air emerge. The sum total of blown air streams 52 of all the air-blowing nozzles 48 disposed on one guide surface member 32 generates the guiding air for the sheets 30 dragged across the guide surface member 32, and the result is a predetermined flow pattern in accordance with the invention. In the gap which forms between each of the sheets 30 and the surface 46, a gap flow is generated, which assures contactless guidance of the sheets 30 over the guide surface member 32. The flow pattern of the gap flow is adjusted so that the resultant of the blown air streams 52 of all of the air-blowing nozzles 48 disposed on the guide surface member 32 is a velocity component of the gap flow in the sheet travel or conveying direction 34 as well as other velocity components which extend from the center of the sheet outwardly symmetrically to the lateral edges of the sheets 30 and directed in the sheet travel or conveying direction. The result over the entire guide surface member 32 is a flaring, trumpet-shaped flow pattern. This orientation of the gap flow assures optimal guidance of the sheets 30 over the guide surface member 32, so that the sheets 30 are guided without fluttering and hence without contacting anything. The arrangement of air-blowing nozzles 48 on the surface member 46 is selected so that they are preferably disposed in rows, offset from one another, transverse to the sheet travel or conveying direction represented by the arrow 34.

Figure 3:
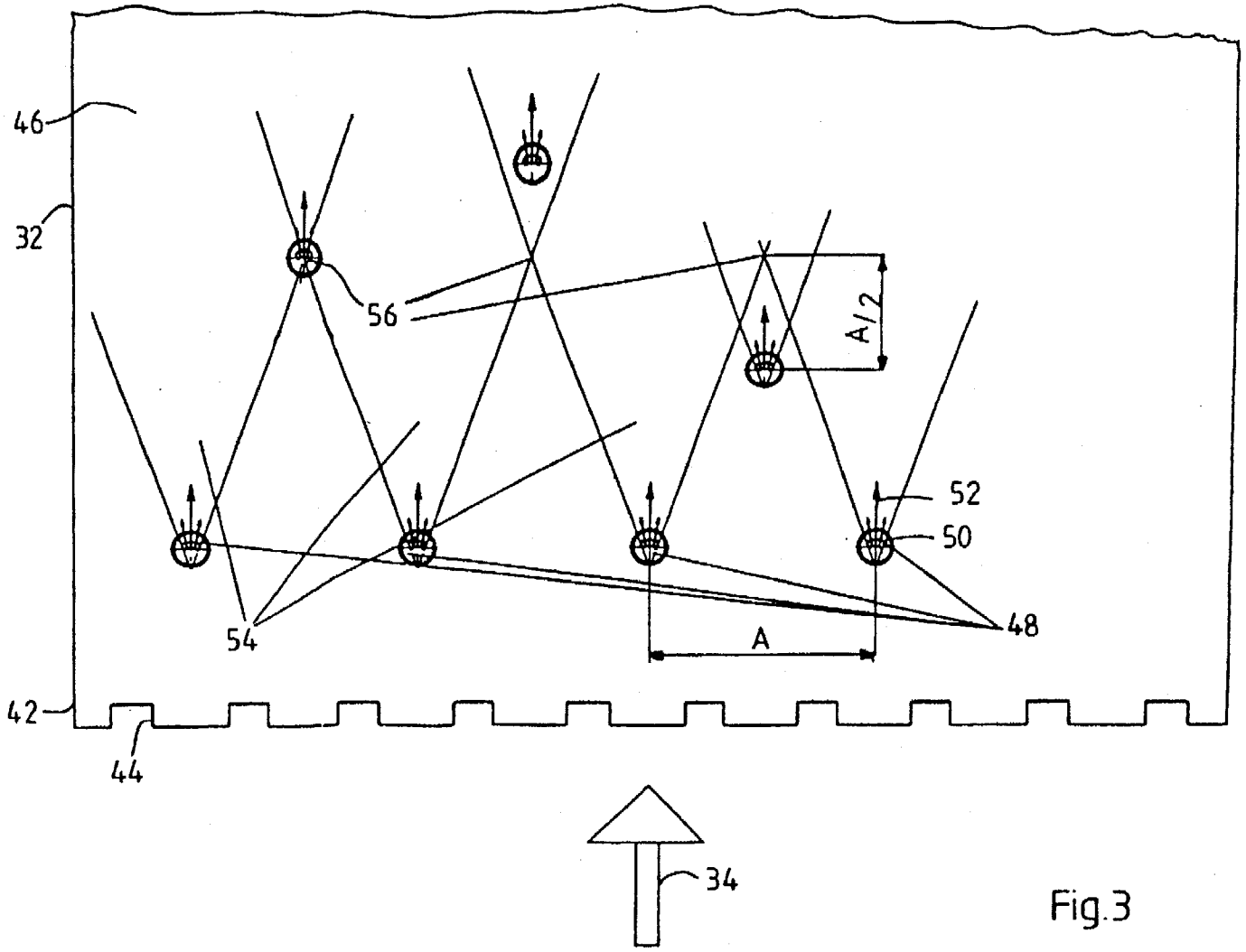
FIG. 3 is an enlarged fragmentary view of FIG. 2, showing one possible arrangement of air-blowing nozzles on the guide surface member.

The arrangement of air-blowing nozzles 48 is shown more clearly in FIG. 3. A first row of side-by-side air-blowing nozzles 48 is disposed on the surface 46 of the guide surface member 32. The air-blowing nozzles 48 are spaced a distance A from one another. Depending upon the shape of the air outlet opening 50 of each air-blowing nozzle 48, the emerging blown air stream 52 has a given divergence region 54. The divergence region 54 widens in funnel-like fashion in the sheet feeding direction represented by the arrow 34. The air-blowing nozzles 48 of a second row downstream from the first row thereof, as viewed in the sheet travel or conveying direction 34, are disposed so that they are located at intersections 56 of the side edges of the divergence regions 54 of the air-blowing nozzles 48 upstream therefrom. This disposition of the air-blowing nozzles 48 at the intersections 56 continues over the entire guide surface member 32. As a result, a uniform gap flow is established between the guide surface member 32 and the sheet 30 guided thereabove, so that no smearing of the sheets 30 occurs. In FIG. 3, the aforementioned arrangement of the air-blowing nozzles is not shown in actual rows, but rather, is merely suggested instead, by means of the air-blowing nozzle shown on the left-hand side of FIG. 3. It is also possible, however, to dispose the air-blowing nozzles 48 upstream or downstream of the intersections 56, as viewed in the sheet travel or conveying direction 34. If the air-blowing nozzles 48 precede the intersection 56, then the spacing of the air-blowing nozzle 48 from the intersection 56 in the sheet travel or conveying direction 34 is at most half the spacing A between two adjacent air-blowing nozzles 48 of the preceding row. The three possible ways of disposing the downstream air-blowing nozzles 48 are shown in FIG. 3. The air-blowing nozzle 48 at the left-hand side of the figure, as noted above, is located at the intersection 56, the air-blowing nozzle 48 in the middle of the figure is located downstream of the intersection 56, and the air-blowing nozzle 48 located at the right-hand side of the figure is disposed a suitable distance upstream of the intersection 56. With each of the three possible arrangements, contactless guidance of the sheets 30 over the guide surface member 32 is attained, the attendant velocity components of the gap flow being established as described hereinabove.

Figure 4:
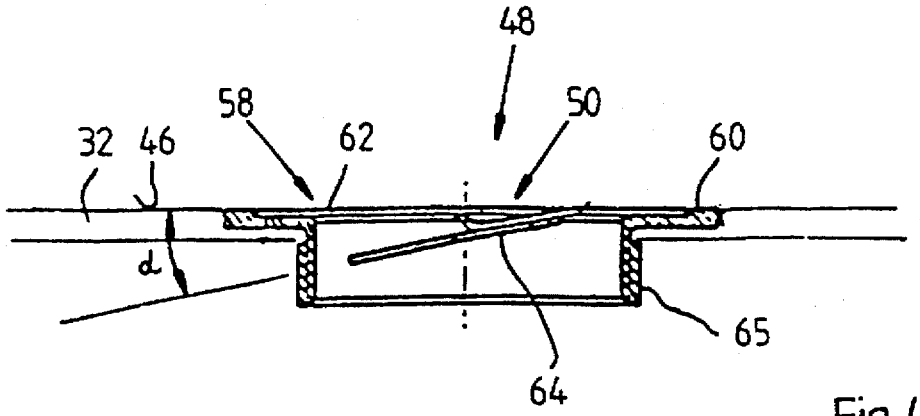
FIG. 4 is a cross-sectional view of an air-blowing nozzle according to the invention.
Figure 5:
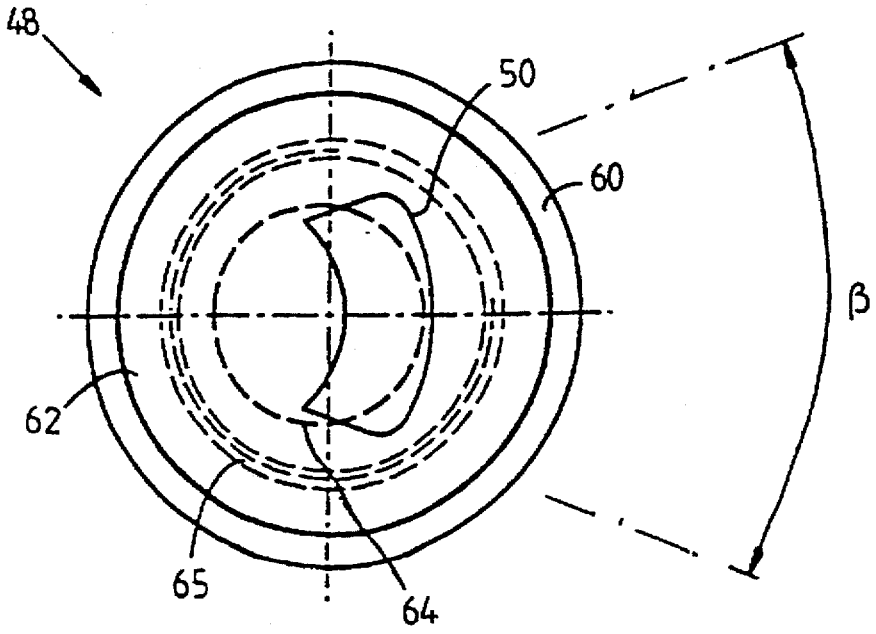
FIG. 5 is a top plan view of FIG. 4.

The structure of the air-blowing nozzles 48 is described hereinafter in conjunction with FIGS. 4 and 5. The sectional view of FIG. 4 shows that, at the locations at which the air-blowing nozzles 48 are disposed, the guide surface member 32 is formed with openings 48 into which the air-blowing nozzles 48 are inserted flush with the surface 46 of the guide surface member 32. The air-blowing nozzles 48, respectively, are formed with an axially symmetrical nozzle bed 60 into which a nozzle plate 60 formed with a curved or arched air outlet opening 50 is introduced and secured therein, for example, by a suitable adhesive. Below the air outlet opening 50, another plate 64 is disposed at the nozzle plate 62, at an angle $\alpha$ from the surface 46. The angle $\alpha$ is preferably 25° . The side surfaces of the nozzle bed 60 extend through the associated opening 58 and are formed with a thread 65 onto which a nut can be screwed so that the air-blowing nozzle 48 can be fixed in position on the guide surface member 32. The air-blowing nozzle 48 is formed essentially of axially symmetrical parts which, in terms of production technology, may be produced simply by bending, punching, laser cutting, stamping, flow-pressing, deep-drawing, or by injection molding, die casting or lost-wax casting. Due to the axially symmetrical construction thereof, the air-blowing nozzles 48 can be turned in a relatively simple manner in the openings 58 and oriented with respect to the sheet travel or conveying direction 34. It becomes clear from the plan view of the air-blowing nozzle 48 shown in FIG. 5 that the air outlet opening 50 extends in a curved or arched fashion, as noted hereinbefore, and has an aperture angle $\beta$ which determines the divergence region 54 shown in FIG. 3. The aperture angle $\beta$ can range from 15° to 90°, depending upon how the air-blowing nozzles 48 are inserted and arranged. In certain arrangements, even larger aperture angles $\beta$ of up to 360° are possible.

The air-blowing nozzles 48 are constructed so that, in the course of the flow of air furnished via the supply line system 38, bottlenecks occur upstream of each air outlet opening 50, and thereby cause a pressure increase. As a result, the potential energy (pilot or inlet pressure) of the air in the air-blowing nozzle 48 is converted, in an especially favorable manner, into kinetic energy, so that the air can flow at high velocity into the gap which forms between the sheet 30 and the guide surface member 32. This reinforces the spreading or fanning out of the air into a flow pattern with a closed film carrying the sheet 30. As a result of the curved or arched air outlet opening 40, which leads to an increase in the outflow cross section for the air in the exposed region of influence on the sheets 30, the suction on the sheets 30 dragged past the air-blowing nozzles 48 can be increased in accordance with Bernoulli's equation; thus, assuming equilibrium of the suction and the gap flow which fans or spreads out in the sheet travel direction 34, and especially so doing symmetrically to the side edges of the sheets 30, the sheet can be moved over the guide surface member 32 without coming in contact therewith. The specialized construction of the air-blowing nozzles 48 and, in particular, of the angle $\alpha$ and the air outlet opening 50 reinforce a tangential inflow of blown air into the gap which forms between the sheet 30 and the guide surface member 32.

In the event that the guide surface members 32 are disposed in regions wherein strong centrifugal forces, for example, in concavely or convexly curved guide surface members 32, or wherein air spreader blades in dryers engage the side of the sheets 30 remote from the guide surface members 32 and act, in the direction of the guide surface member 32, upon the sheets 30 moving past, then to compensate for these increased effects, the angle $\alpha$ can, in particular, be increased to as much as 60° , so that a pulsing force component of the gap flow is generated to compensate for these factors.

Figure 6:
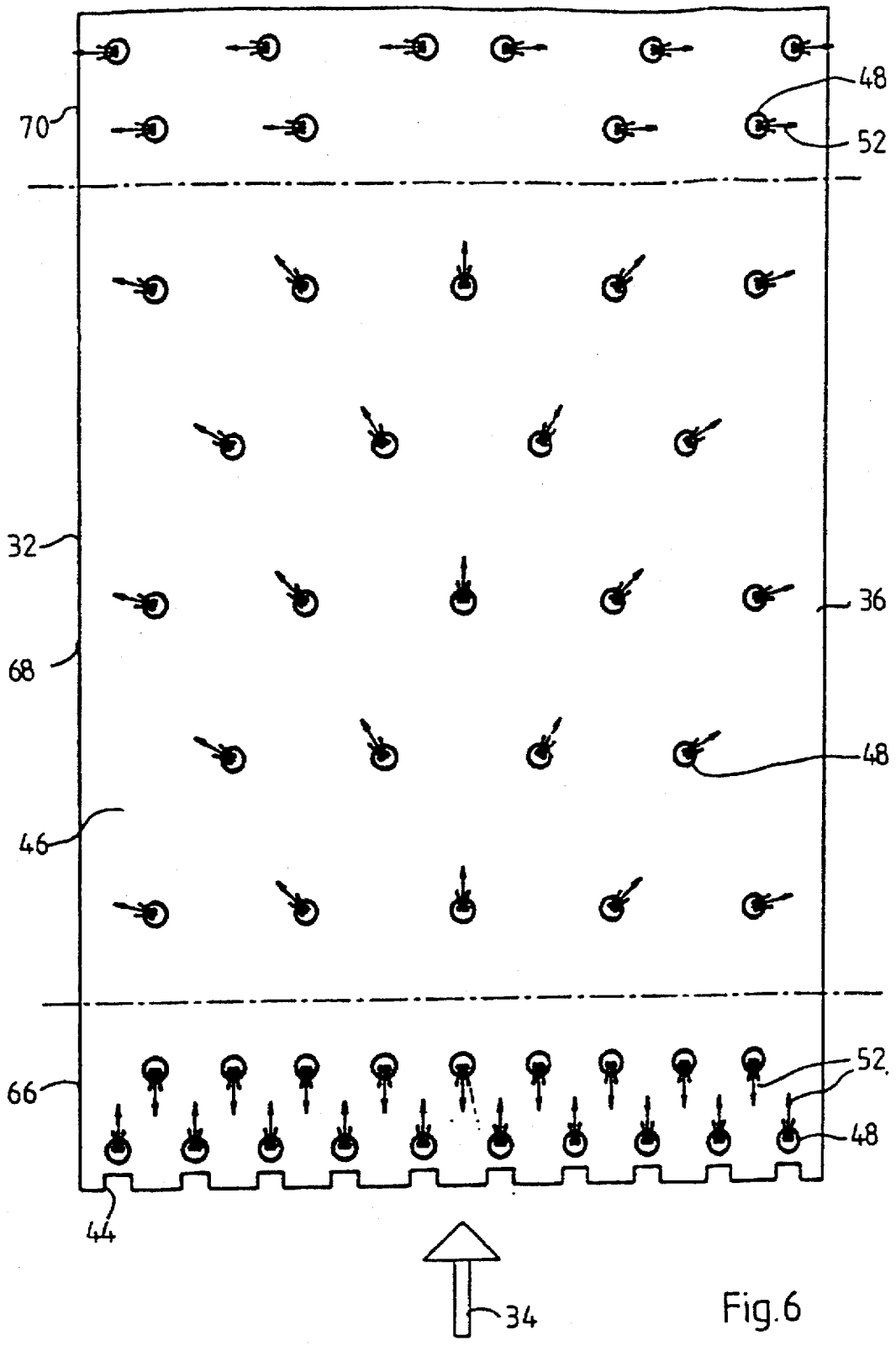
FIG. 6 is a view like that of FIG. 2 of a guide surface member with another arrangement of the air-blowing nozzles.

To improve contactless guidance of the sheets 30, the guide surface member 32, which is formed uninterruptedly, in particular, in one piece, in the sheet travel or conveying direction 34 can have individual functional zones located in succession in the sheet travel direction 34. FIG. 6 shows one guide surface member 32 constructed in this manner. In the event that a guide surface member 32 is formed of a plurality of successively disposed segments 36, respectively separated from its neighbors by a gap, for example, then the subdivision into the functional zone applies preferably for each segment 36. The guide surface member 32 has in succession an inlet zone 66, a guide zone 68, and an outlet zone 70. A guide surface member 32 without this zonal division has, in effect, only a single zone, here corresponding to the guide zone 68. The zones 66, 68 and 70 are adapted to the various functional demands made of them and also to their task within the entire guide surface member 32. The differences may reside in the arrangement and/or alignment of the air-blowing nozzles 48, including the different layout thereof with respect to the angles $\alpha$ and/or $\beta$ shown in FIGS. 4 and 5.

The inlet zone 66 is so formed that an oncoming sheet 30 is tautened counter to the sheet travel direction represented by the arrow 34. To that end, air-blowing nozzles 48 for discharging blown air streams 52 extending in mutually opposite directions are disposed offset from one another in two rows. With this construction, a sheet 30 entering the inlet zone 66 becomes taut and is stabilized in a floating position, thus assuring that the sheet 30 can enter the next guide zone 68 without fluttering. The blown air streams 52 directed counter to the sheet travel or conveying direction 34 prevent the sheet 30 from being guided onto the guide surface member 32 due to the occurring centrifugal forces.

Figure 7:
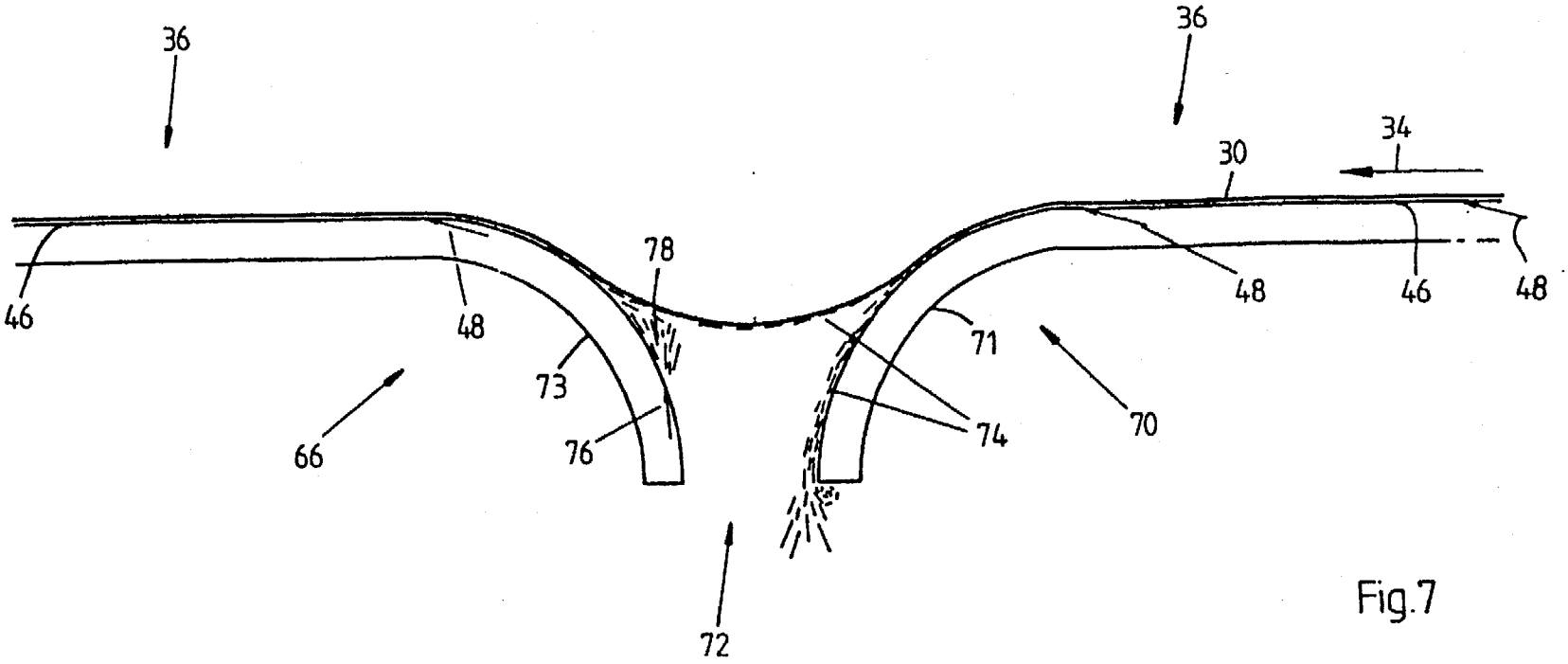
FIG. 7 is a diagrammatic side elevational view of two segments of a guide surface member with a transition therebetween.

The inlet zone 68 may either extend in alignment with the entire guide surface member 32, or in other words have a flat course or have a correspondingly matched, respective concave and convex curvature. The front edge region may be formed flat or, as shown in further detail in FIG. 7, is formed rounded or arched. The blown air streams 52 directed counter to the sheet travel direction 34 simultaneously prevent any influence from being exerted upon regions preceding the guide surface member 32 by guiding air flows as a consequence of the gap flow between the guide surface member 32 and a sheet 30 guided thereabove. The inlet zone 66 is formed with the recesses 44 for grippers which engage the sheets 30, so that a type of toothing is provided in the region of the inlet zone 66 in order to enable the maintenance of minimum gap openings between the guide surface member 32 and the sheet 30.

The guide zone 68 following the inlet zone 66 assumes the task of contactless guidance of the sheets 30 in this region of the guide surface member 32. The disposition of the air-blowing nozzles 48 is selected so that, as resultants of the blown air streams 52 of all the air-blowing nozzles 48 disposed in the guide zone 68, one velocity component of the gap flow is established in the sheet feeding direction 34, a further velocity component beginning at the center of the sheet and extending to one lateral edge is established, and yet another velocity component extending to the other lateral edge of the sheets 30 is also established. The last two velocity components can preferably be formed symmetrically to one another. The arrangement of air-blowing nozzles 48 can deviate from the arrangements described in conjunction with FIGS. 2 and 3 if the condition of the three required velocity components of the gap flow is met. In any case, the air-blowing nozzles 48 should be disposed so that they do not interfere with one another, i.e., the blown air streams 52 of one air-blowing nozzle 48 should not compensate for the blown air streams 52 of a further air-blowing nozzle 48, or cause them to become turbulent, or the like.

The guide zone 68 is followed in the sheet travel or conveying direction 34 by the outlet zone 70 which, once again, like the inlet zone 66, may be rounded or arched, as shown in further detail in FIG. 7, in a manner directed away from the guide surface member 32 or, in other words, away from the travel or movement path of the sheets 30. However, the outlet zone 70 may also be formed without this rounding or arching or, in other words, can terminate abruptly. The constructive orientation or alignment of the outlet zone 70 depends upon the machine elements which follow the guide surface member 32. If the guide surface member 32 is followed by a machine element with which contact by the sheets 30 should be avoided, then the outlet zone 70 is disposed at a higher level or at the same level as the following guide device. However, if the sheets 30 are to be brought within the range of influence of machine elements of the following guide device, for example, a front lay, a sheet brake, a sheet unroller, and so forth, then the outlet zone 70 should be disposed at a level ranging from lower to a maximum of the same height. The outlet zone 70 has an arrangement of the air-blowing nozzles 48 causing the blown air streams 52 thereof to be directed transversely to the sheet travel direction 34. The air-blowing nozzles 48 are arranged symmetrically in the outlet zone 70, so that a gap flow pattern directed uniformly away from the center of the sheet to both side edges results. This prevents the trailing edge of the sheets 30 from starting to flutter and becoming smeared, upon leaving the guide surface member 32. Moreover, it prevents the guiding air, that is, the gap flow which is established in the guide zone 68, from being able to affect the guide devices following the guide surface member 32. An outflow of guiding air or, in other words, of the gap flow which develops between the guide surface member 32 and the sheet 30, into the side regions is thus assured, so that in following critical guide devices, fluttering or like motions of the trailing edge of the sheets is prevented.

FIG. 7 shows the transition between two segments 36 which are disposed in succession in the sheet feeding direction represented by the arrow 34 and which together are a component of a guide surface member 32. It becomes clear that both the outlet zone 70 of the segment 36 which comes first in the sheet travel direction 34 and the inlet zone 66 of the next segment 36 have a rounding or arching 71 and 73, respectively, directed away from the respective flat surface 46. The segments 36 are spaced apart from one another, which results in the formation of a gap 72 between the outlet zone 70 of the first segment 36 and the inlet zone 66 of the second segment 36. Arrows indicate the various air-blowing nozzles 48, however, their specific orientation will not be discussed in any further detail at this juncture. Because a sheet 30 is dragged over the segments 36 by non-illustrated grippers, a gap flow 74 develops between the sheet 30 and the surface 46 and forms the guiding air for the sheet 30. As a result of the so-called Coanda effect, the gap flow 74 adhesively adheres partly to the sheet 30 and the remainder to the rounding or arching 71 of the outlet zone 70. Consequently, part of the sheet 30 is drawn into the gap 72, but without smearing on the rounded part 71 of the outlet zone 70. To prevent smearing of the sheets 30 on the rounded part 73 of the inlet zone 66 of the next segment 36, this latter segment is preceded by at least one air-blowing nozzle 76, which provides an air film between the inlet zone 66 and the sheet 30. The air flow 78 generated by the additional air-blowing nozzle 76 combines with the portion of the gap flow 74 adhesively adhering to the sheet 30. As a result, the sheet 30 does not touch the inlet zone 66.

Figure 8:
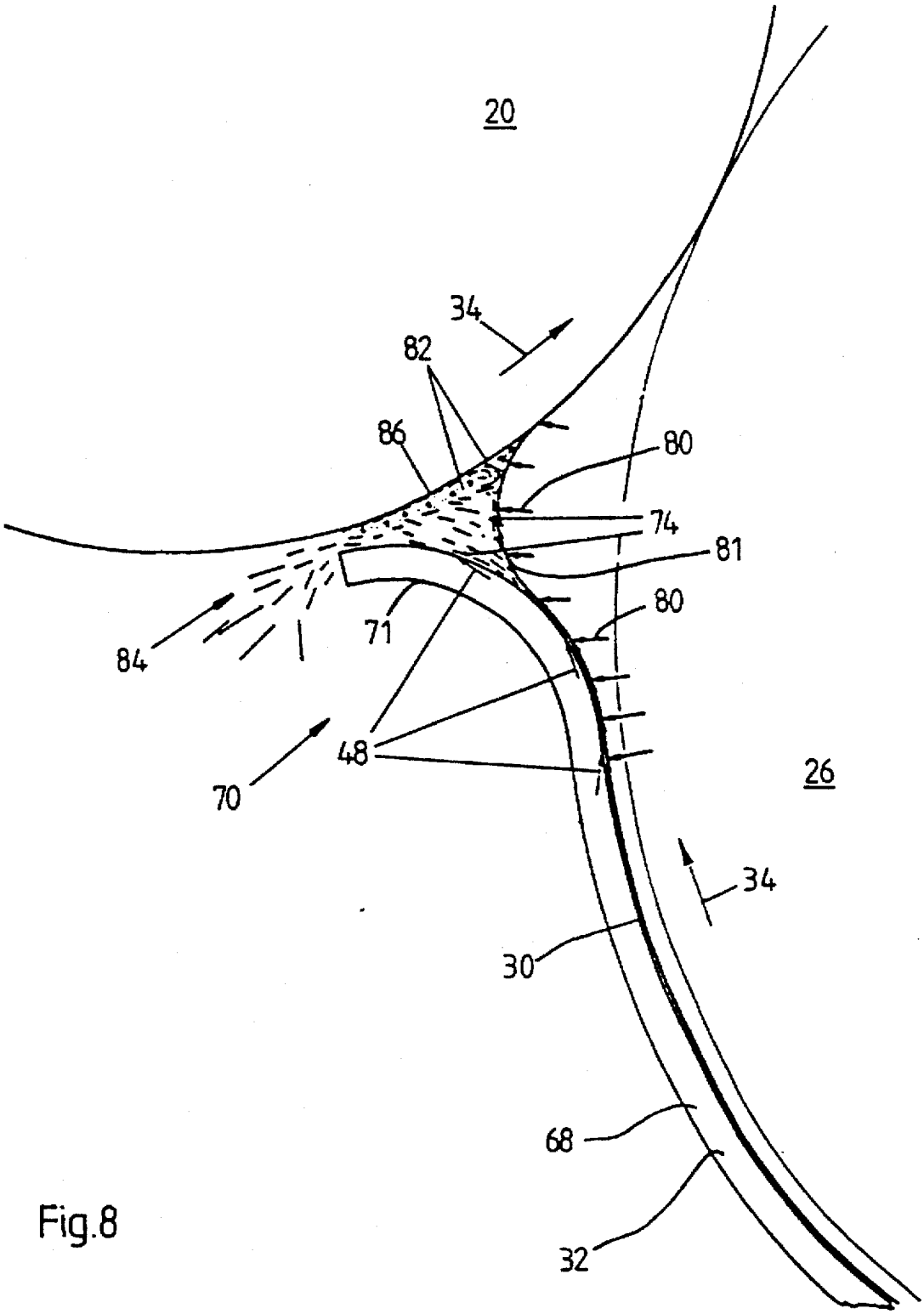
FIG. 8 is a diagrammatic side elevational view of a segment of a guide surface member and a cylinder and a transition therebetween.

FIG. 8 diagrammatically illustrates the transition from a sheet guiding cylinder 26 to a following cylinder, for example, an impression cylinder 20. The cylinders 20 and 26 rotate about the axes thereof and thus establish the sheet travel or conveying direction represented by the arrow 34. The sheet 30 is guided around the sheet guiding cylinder 26 by non-illustrated grippers and transferred to likewise non-illustrated guiding devices of the print cylinder 20. The sheet guiding cylinder 26 has a curved guide surface member 32 assigned thereto having a surface 46 which extends parallel to the jacket of the cylinder 26. The guide surface member 32 has a guide zone 68 and a rounded part 71 directed away from the desired travel or movement path of the sheet 30 and provided with an outlet zone 70. The outlet zone 70 has the air-blowing nozzles 48, here represented by arrows. During the motion of the sheet 30, centrifugal forces suggested by arrows 80 and resulting from the rotation of the sheet guiding cylinder 26 about the cylinder axis thereof, as well as thrust forces of the developed gap flow 74 which acts as guiding air upon the sheet 30 in the transition region between the cylinders 26 and 20 cause a bowing at 81 of the sheet 30. Because of the Coanda effect, the gap flow 74 again adheres adhesively partly to the sheet 30 and partly to the outlet zone 70. The portion of the gap flow 74 adhering to the sheet 30 is guided partly towards the jacket surface of the cylinder 20, where it forms a turbulence and damming zone 82. The portions of the gap flow 74 adhering to the outlet zone 70 flow away at 84 counter to the direction of rotation of the cylinder 20. As a result of the rotary motion of the cylinder 20, a boundary layer 86 forms on the surface thereof and provides a partial air flow in the region of the turbulence and damming zone 82. Due to the development of the turbulence and damming zone 82, excessive bowing or bending of the sheet 30 by the centrifugal and thrust forces 80 is averted. At the same time, contact of the sheet with the jacket surface of the cylinder 20 is prevented thereby.

Figure 12:
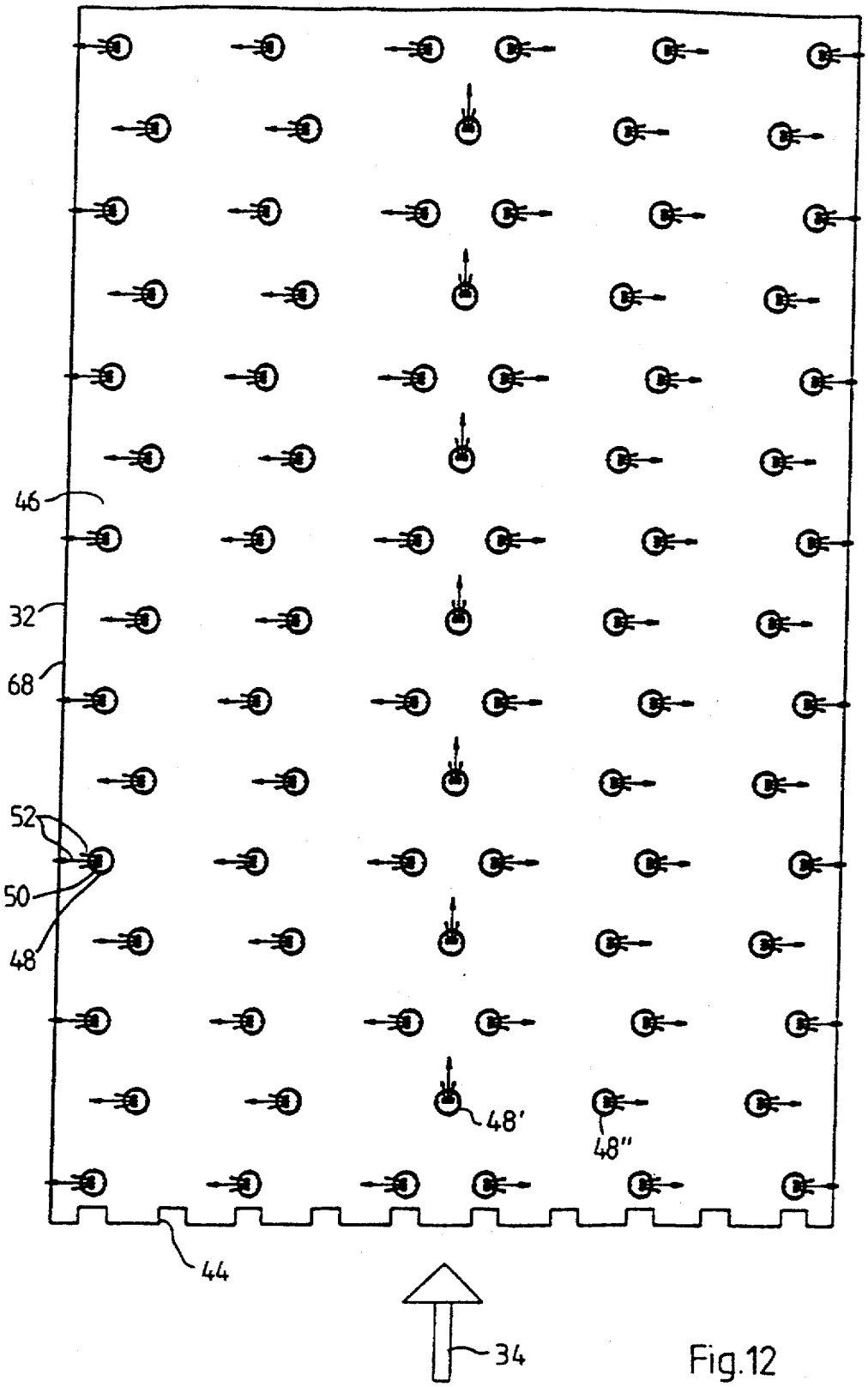
Figure 13:
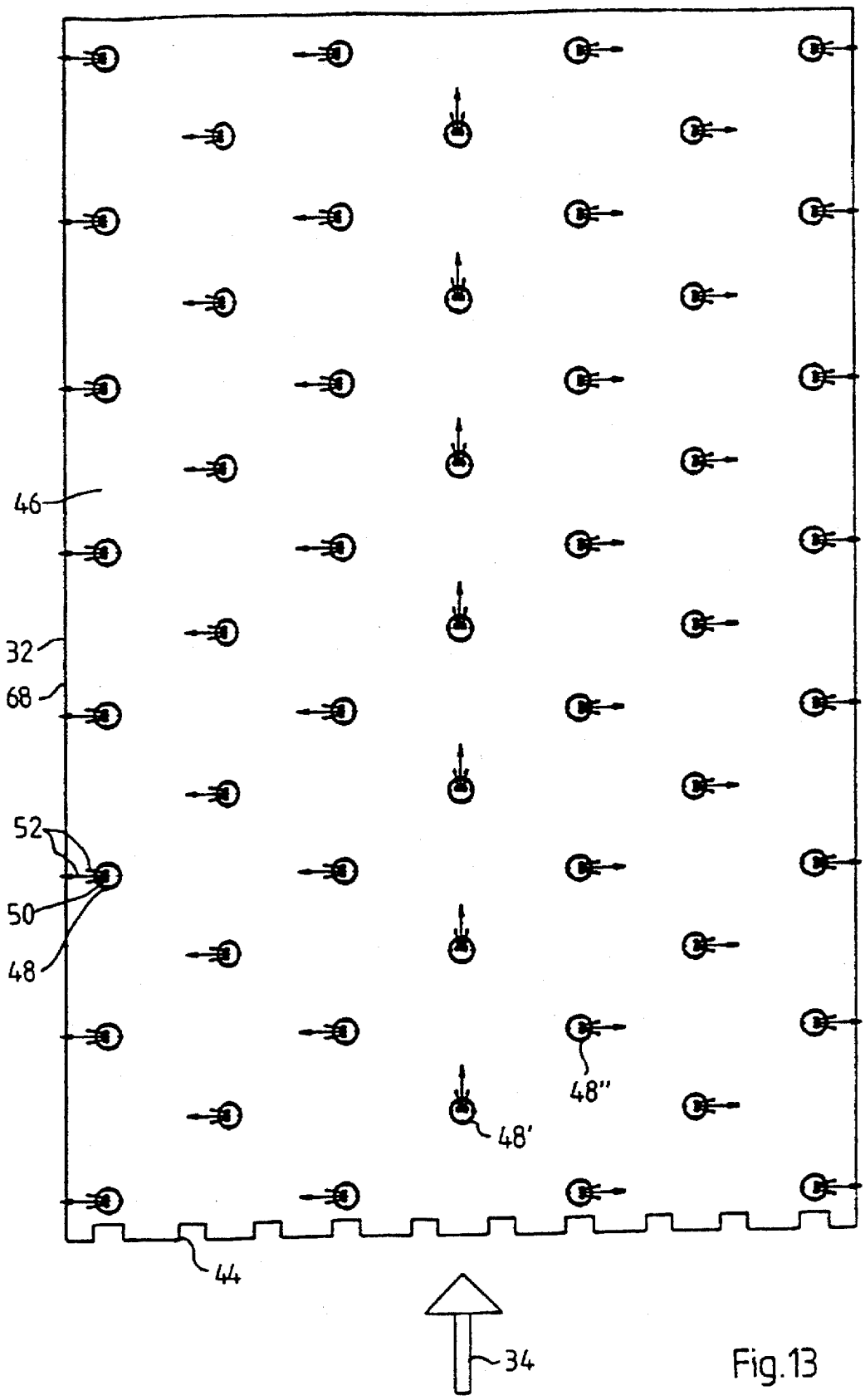
Figure 14:
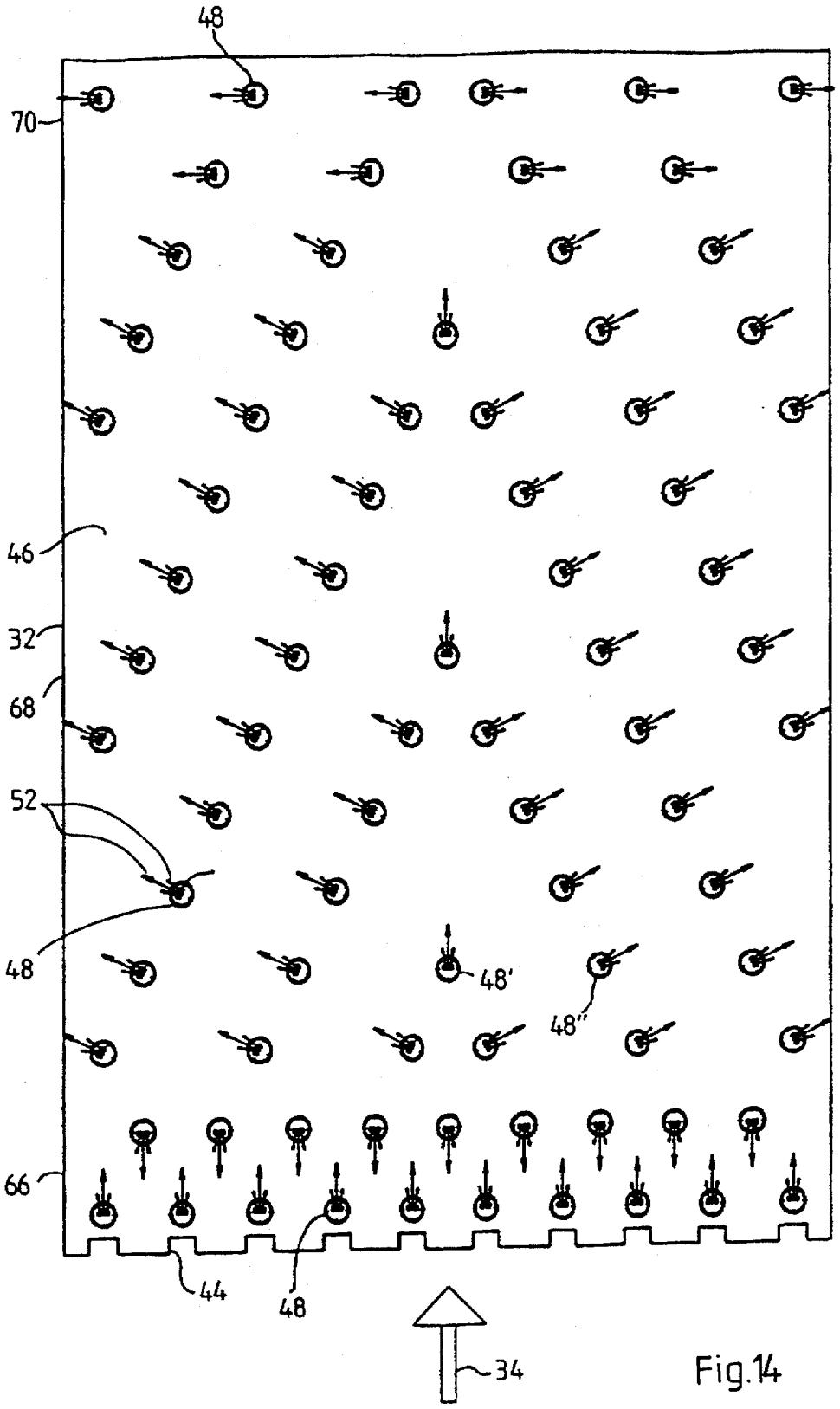
Figure 15:
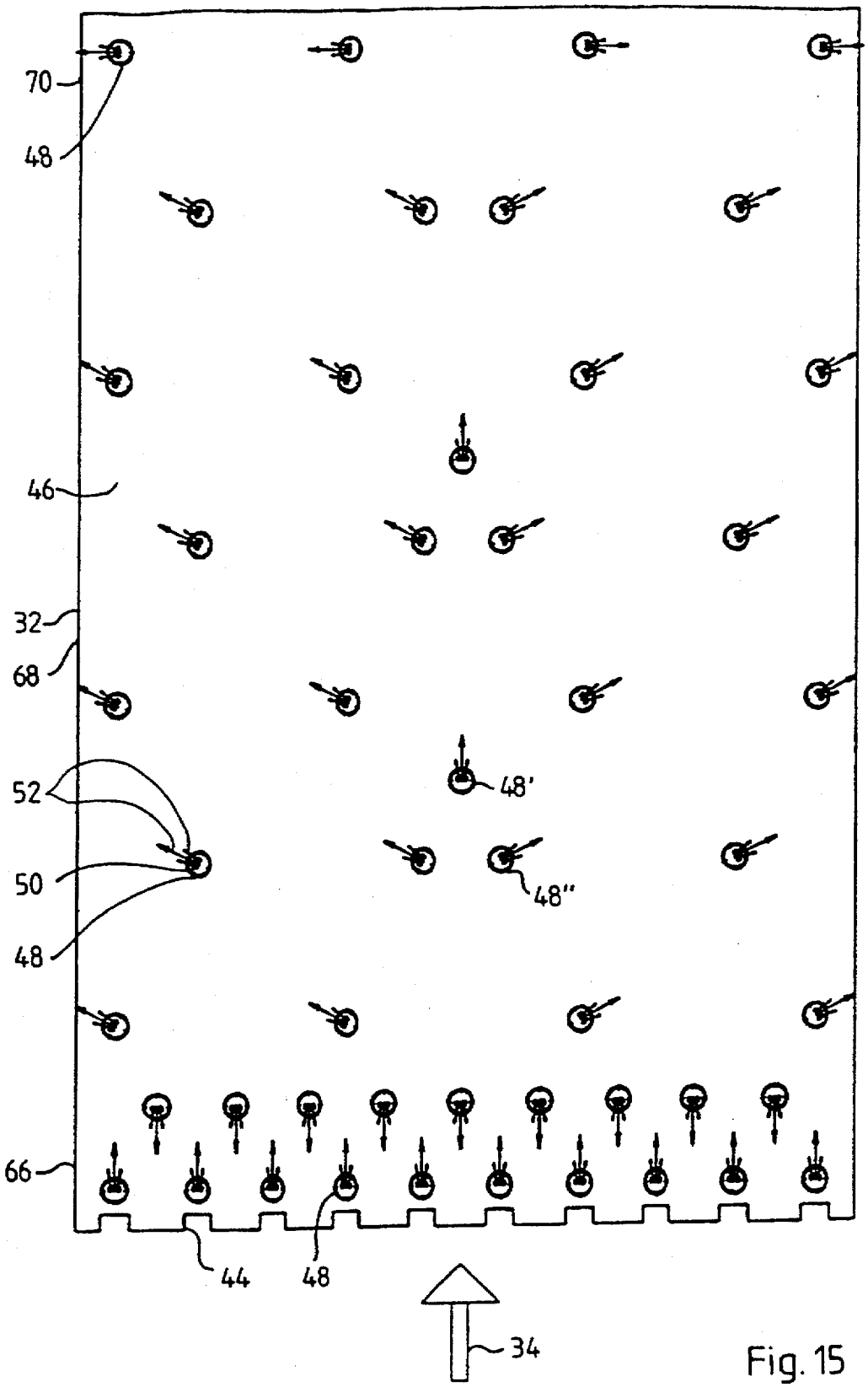
Figure 16:
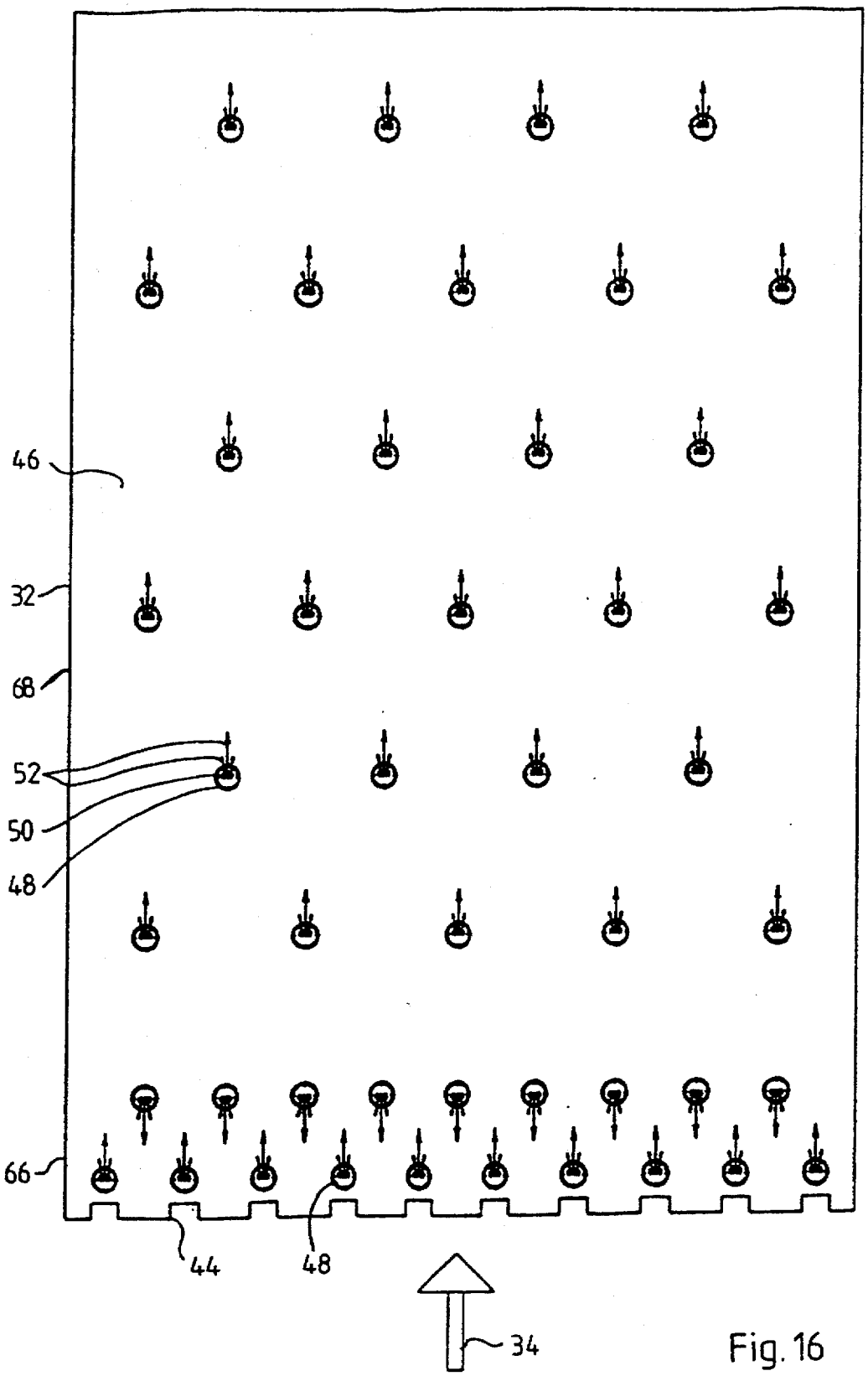

In FIGS. 9 to 16, other possible arrangements of the individual air-blowing nozzles 48 on the guide surface member 32 are shown by way of example. In FIGS. 9 to 13, the guide surface member 32 has a guide zone 68 only, but no inlet zone 66 or outlet zone 70. In FIGS. 14 to 16, various exemplary embodiments of guide surface members 32 are shown that have inlet zones 66, guide zones 68 and outlet zones 70. Which of the guide surface members 32 is contemplated for which application or which installation site within the printing press 10 depends upon the magnitude of the danger of smearing of the sheets 30 guided over the guide surface members 32. At uncritical points, guide surface members 32 can be provided which have no separately formed inlet zone 66 or outlet zone 70. A decisive factor for the optional arrangements of the air-blowing nozzles 48, shown here solely by example, is that over the entire guide surface member 32, or at least over the guide zone 68, a gap flow develops which has one velocity component in the middle of all the air-blowing nozzles 48 in the sheet travel or conveying direction represented by the arrow 34, another velocity component beginning at the middle of the sheet and extending to one lateral edge thereof, and a further velocity component to the other lateral edge of the respective sheet 30. The various individual air-blowing nozzles 48 are arranged so that the air flows thereof do not interfere with one another.

Figure 9:
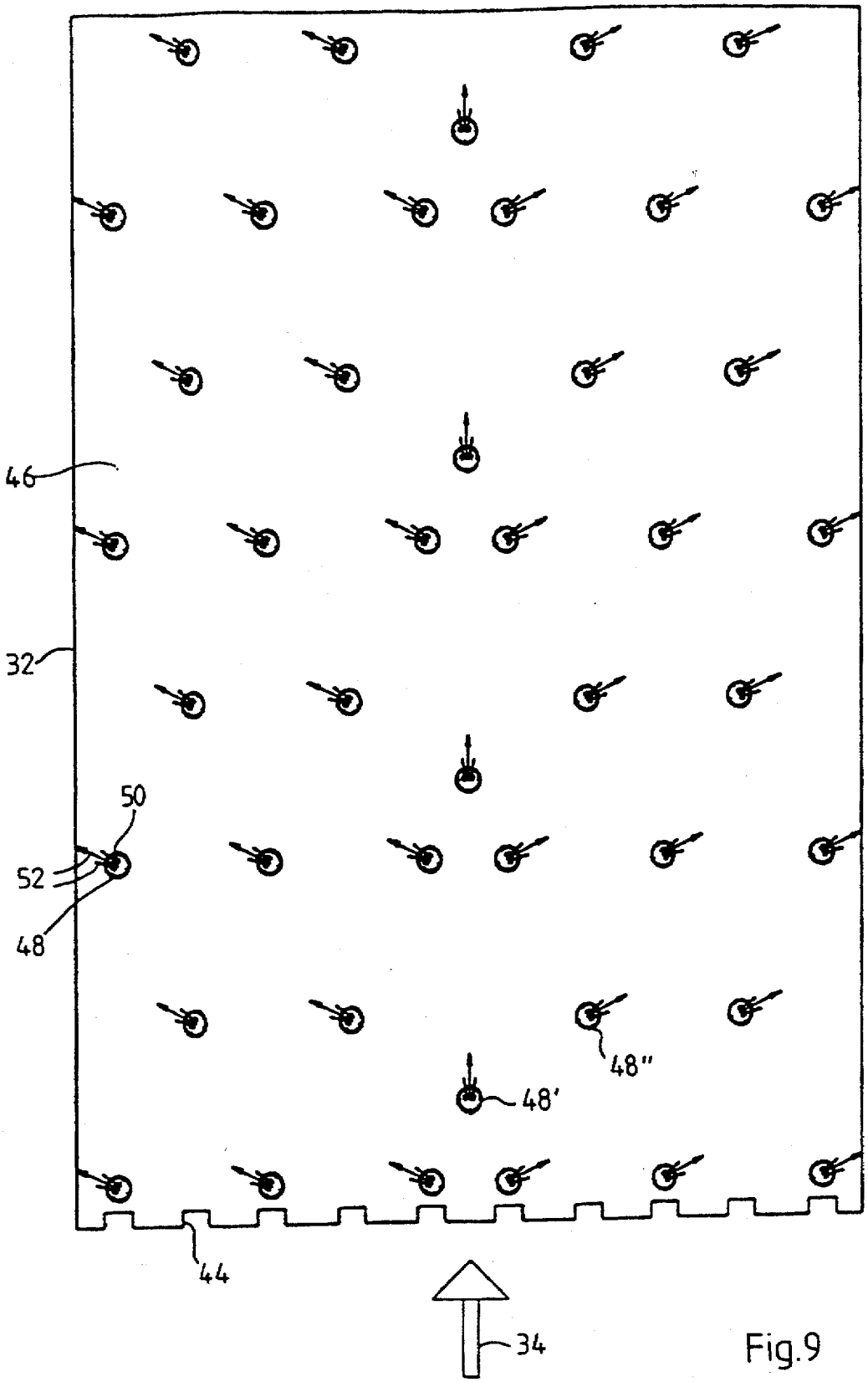
FIGS. 9 to 16 are views like those of FIGS. 2 and 6 showing other possible arrangements of nozzles on a segment of a guide surface member.

In the exemplary embodiment shown in FIG. 9, first air-blowing nozzles 48', as viewed in the sheet travel direction 34, are disposed on an imaginary center line of the guide surface member 32, and provide blown air streams directed essentially in the sheet travel direction 34. Symmetrically to these first air-blowing nozzles 48', second air-blowing nozzles 48" are disposed on both sides of the imaginary center line and provide blown air streams respectively directed towards the side edges of the guide surface member 32. The second air-blowing nozzles 48" are disposed in rows offset from one another and extending transversely to the sheet travel direction 34, and the blown air streams of the air-blowing nozzles 48" are directed symmetrically to the side edges in the sheet travel direction 34, at an angle other than 90° relative to the sheet travel direction 34. The second air-blowing nozzles 48" are respectively disposed offset from one another in successive rows. The blown air streams of the air-blowing nozzles 48' always are directed here to a gap formed by two air-blowing nozzles 48" disposed downstream of the second air-blowing nozzles 48" in the blowing direction.

Figure 10:
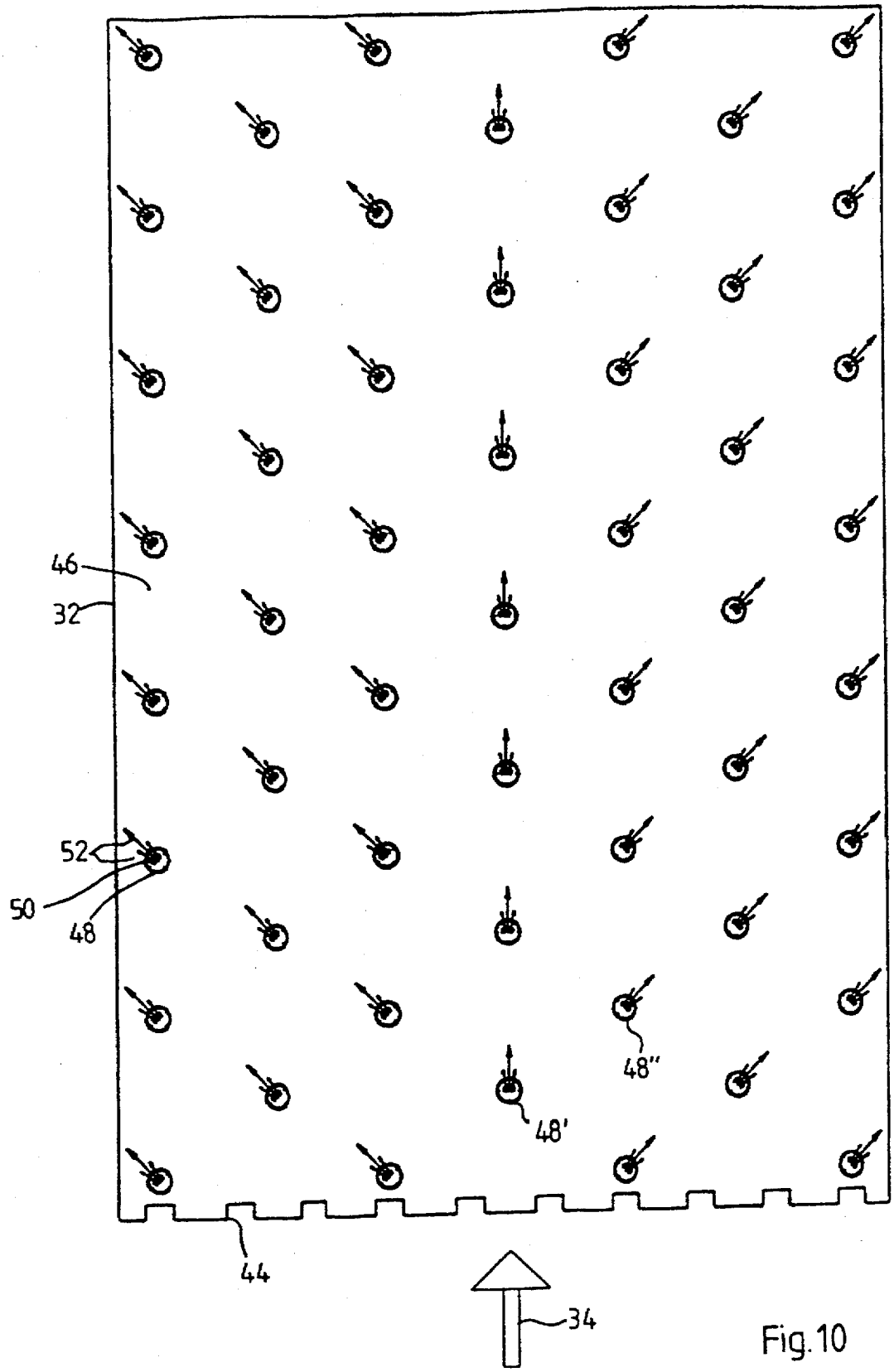
Figure 11:
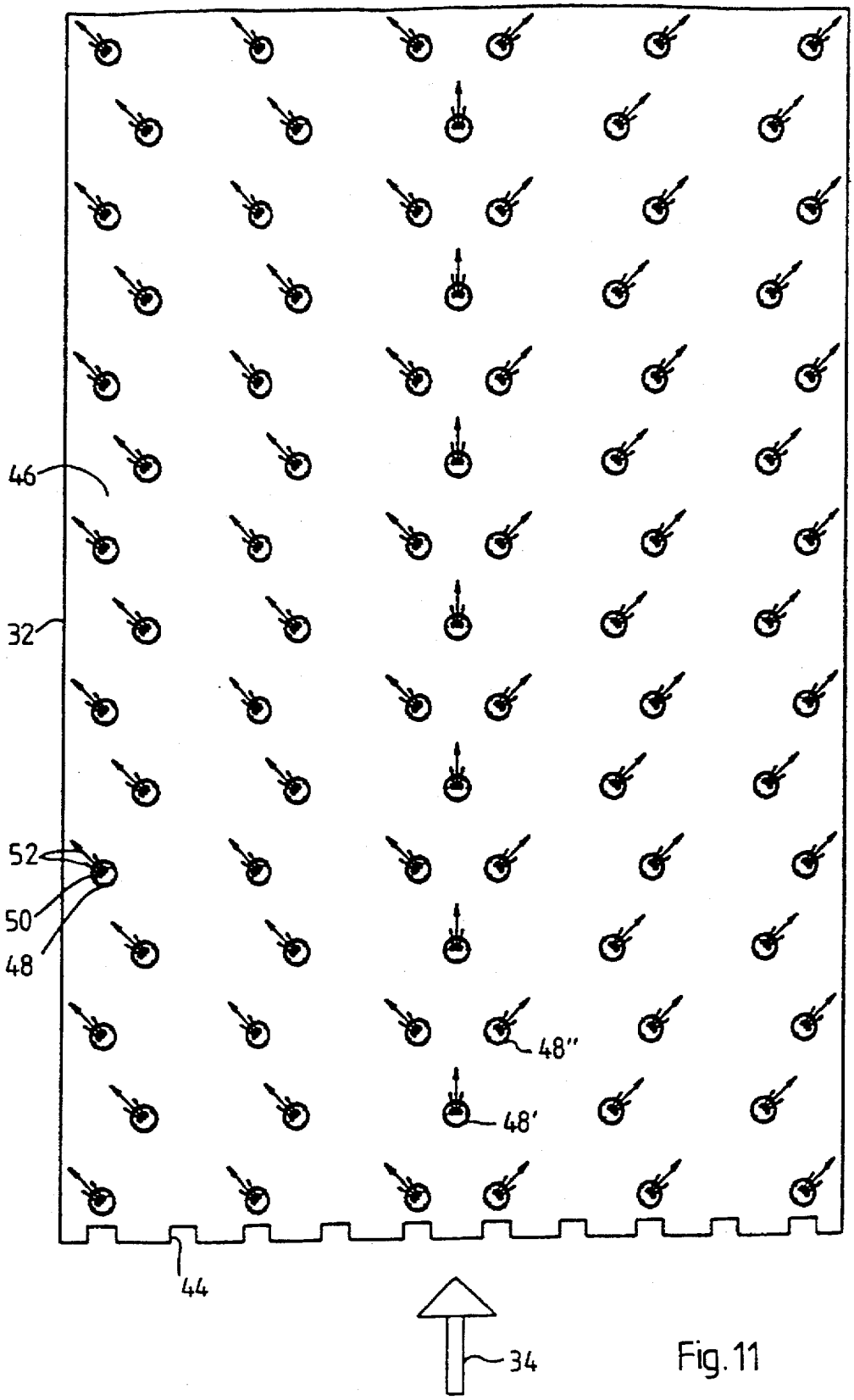

In the different embodiment shown in FIG. 10, first air-blowing nozzles 48' are again disposed on an imaginary center line of the guide surface member 32 in the sheet feeding direction 34 and provide blown air streams directed essentially in the sheet feeding direction 34. The second air-blowing nozzles 48' provided here as well are disposed in rows which are offset from one another and extend transversely to the sheet feeding direction 34, the first air-blowing nozzles 48' respectively being located at the same level as a second row of air-blowing nozzles 48". The second air-blowing nozzles 48" direct the air streams blown therefrom symmetrically to the side edges of the guide surface member 32 at an angle other than 90° with respect to the sheet travel direction represented by the arrow 34. The second air-blowing nozzles 48" are arranged offset from one another in two successive rows so that the blown air streams of the second air-blowing nozzles 48" are directed essentially at an air-blowing nozzle 48" located downstream therefrom in the blowing direction of the next row of second air-blowing nozzles 48", as viewed in the sheet travel direction 34.

In the exemplary embodiment shown in FIG. 11, once again first air-blowing nozzles 48' are provided which blow essentially in the sheet travel direction 34 and are disposed on an imaginary center line of the guide surface member 32. The second air-blowing nozzles 48", likewise disposed in rows extending transversely to the sheet travel direction 34, are disposed in immediately successive rows offset from one another but not symmetrically offset from one another. The result is that the blown air streams of the second air-blowing nozzles 48" are directed essentially at an air-blowing nozzle 48" of a row of second air-blowing nozzles 48" once removed therefrom, i.e., next to it but one.

In FIGS. 12 and 13, exemplary embodiments are shown wherein the first air-blowing nozzles 48' are again disposed on an imaginary center line of the guide surface member 32 extending in the sheet travel direction represented by the arrow 34, and blown air streams produced thereby are again directed essentially in the sheet travel direction 34. The second air-blowing nozzles 48" are again disposed in rows offset from one another and disposed transversely to the sheet travel direction 34, and the blown air streams of the second air-blowing nozzles 48" are directed essentially symmetrically, transversely to the sheet travel direction 34, to the respective side edges of the guide surface member 23. The exemplary embodiments in FIGS. 12 and 13 differ only in the number of second air-blowing nozzles 48" that are respectively disposed in one row.

In the exemplary embodiment shown in FIG. 14, the guide surface member 32 has an inlet zone 66 which has air-blowing nozzles 48 in two rows extending parallel to one another, blown air streams therefrom being directed counter to one another. A first row of air-blowing nozzles 48 directs blown air streams therefrom essentially in the sheet travel direction 34, while the second row of air-blowing nozzles 48 directs blown air streams therefrom essentially opposite to the sheet travel direction 34. The air-blowing nozzles 48 of the two rows are symmetrically offset from one another. The air-blowing nozzles 48 disposed in the guide zone 68 are formed by first air-blowing nozzles 48' which again are disposed on an imaginary center line of the guide surface member 32, and second air-blowing nozzles 48" which are disposed in rows extending transversely to the sheet travel direction 34. The second air-blowing nozzles 48" are offset from the air-blowing nozzles 48" disposed in the adjacent row so as to produce a pyramidlike structure of second air-blowing nozzles 48" extending in the sheet travel direction 34. The blown air streams of the second air-blowing nozzles 48" are directed essentially towards an air-blowing nozzle 48" which is disposed in a following row, as viewed in the sheet travel direction 34. In the outlet zone 70, the air-blowing nozzles 48 are disposed in two rows extending parallel to one another, and the air streams blown therefrom are oriented so that a flow pattern extending symmetrically transversely to the sheet travel direction 34 results therefrom.

In the exemplary embodiment shown in FIG. 15, the guide surface member 32 has an inlet zone 66 which corresponds to that shown in FIG. 12. In the guide 68, once again first air-blowing nozzles 48' are disposed on an imaginary center line of the guide surface member 32, and second air-blowing nozzles 48" are disposed in rows extending transversely to the sheet travel direction 34. The second air-blowing nozzles 48" are disposed offset from one another in successive rows, so that the blown air streams therefrom are directed towards a gap formed by the air-blowing nozzles 48" disposed downstream from the second air-blowing nozzles 48", as viewed in the blowing air direction. The air-blowing nozzles 48 of the outlet zone 70 are disposed here in one row and produce blown air streams directed symmetrically transversely to the sheet feeding direction 34.

In FIG. 16, an exemplary embodiment is shown wherein, in the inlet zone 66, air-blowing nozzles 48 are again disposed in two rows offset from one another and transversely to the sheet travel direction 34, as described hereinbefore with regard to FIGS. 14 and 15. In the guide zone 68, air-blowing nozzles 48 are disposed again in rows extending transversely to the sheet travel direction 34, the blown air streams from which are respectively directed essentially in the sheet travel direction 34. In the arrangement of air-blowing nozzles 48 in the guide zone 68, as shown in FIG. 16, the spacings between the air-blowing nozzles 48, shown in FIG. 3 by way of example, should be observed.

Figure 17:
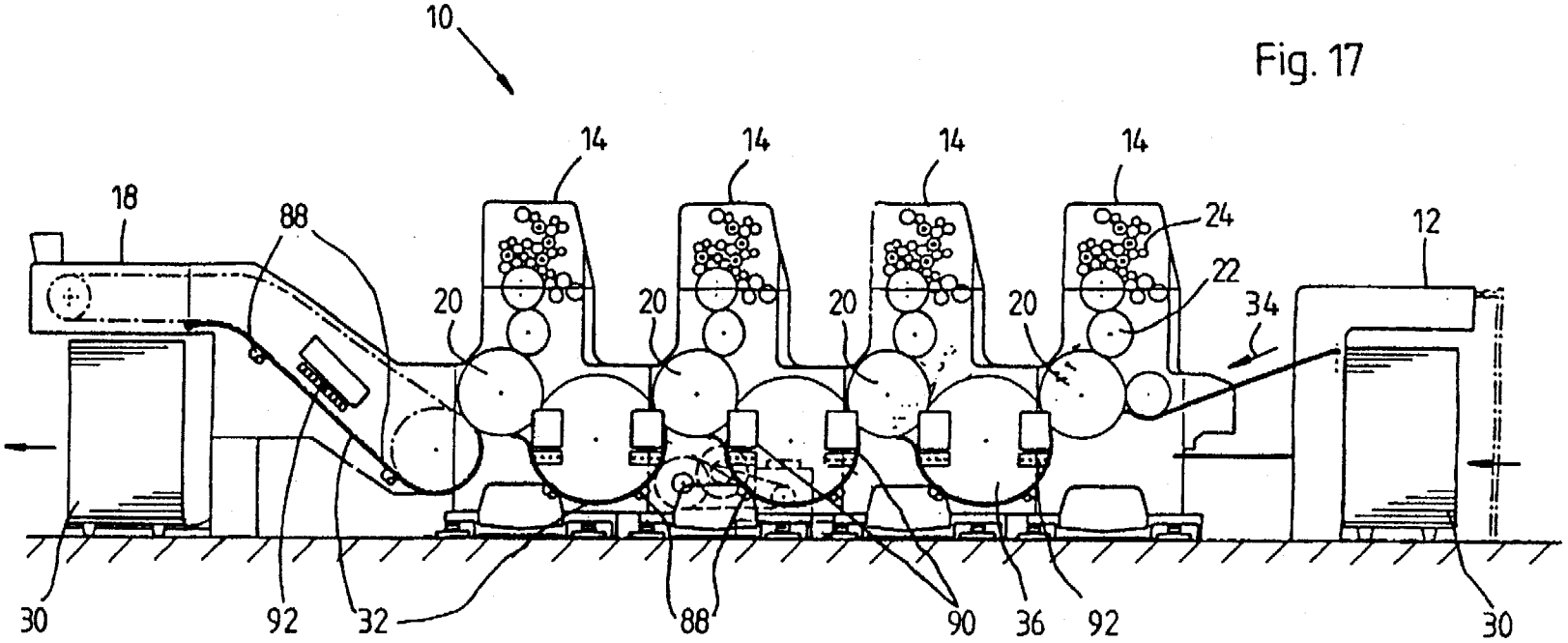
FIG. 17 is view like that of FIG. 1, showing a sheet-fed printing press of another type with another embodiment of the contactless guidance device according to the invention.

In FIG. 17, a further sheet-fed printing press 10 is diagrammatically shown in an overall view. Elements shown therein which are identical to those of FIG. 1 are identified by the same reference numerals and are not described again here. In conjunction with the view shown in FIG. 17, possible variations in air delivery to the guide surface members 32 are discussed hereinafter. The guide surface members 32 can again have either a flat form or a concavely or convexly curved form. In terms of the arrangement of individual air-blowing nozzles 48 on the guide surface members 32, and/or on the subdivision of the guide surface members 32 or individual segments 36 of the guide surface members 32, such as an inlet zone 66 and/or guide zone 68 and/or outlet zone 70, suitable reference should be made to the description of the figures of the drawings described hereinabove. In principle, any option to suit the specific application is possible.

In principle, it is possible to dispose separate air supply units below the guide surface members 32; by way of example, these units are embodied in the form of a rectangular or square tube and are a component of the supply line system 38 shown in FIG. 1. As an alternative, however, the guide surface member 32 itself may be formed as a hollow body, for example a sheet-metal box, having a side thereof facing towards the sheet 30 and provided with the air-blowing nozzles 48. The side facing towards the sheet 30 then is formed either with the openings 58 (FIG. 4) for receiving the air-blowing nozzles 48, or else these openings are stamped directly, for example, into the wall facing towards the sheet 30. The hollow chamber having the guide surface member 32 may be structurally split into separate individual segments, for example, by providing partitions therebetween. The segments may extend either in the sheet travel direction 34 or transversely to the sheet travel direction 34. By way of example, in an embodiment of the guide surface member 32 with an inlet zone 62, a guide zone 68 and an outlet zone 70, each of these zones may be assigned its own segment. The various segments can, in turn, be connected, as in the exemplary embodiment shown in FIG. 1, either jointly to the supply line system 38 or separately via a separate route to that system. All the guide surface members 32 of one sheet-fed printing press 10 are thus supplied with the blowing air via a central blower 40. However, it is also possible to provide a plurality of separate blowers 40 and thus assign one blower 40, for example, to the guide surface members 32 associated with each individual printing unit 14. As a result, the supply line system 38 assigned to each blower 40 is smaller, which reduces the occurrence of supply line losses. Another option is to assign blowers 88 directly to the guide surface members 32 with the blowers disposed immediately at or, in other words, below the guide surface members 32. This is shown in FIG. 18. This provision affords a further reduction in supply line losses. If the blowers are directly assigned to the guide surface members 32, it is also possible to aspirate the air as waste air at the place where this air occurs or, in other words, after it has been used as guiding air for the sheets 30, laterally of the sheet edges or from outflow openings provided in the guide surface members 32. As a result, any influence upon further machine parts of the sheet-fed printing press 10, for example, the impression cylinders 20, by the guiding air (gap flow 74) used, highly advantageously, for contactless guidance of the sheet 30 is largely avoided. Optionally, this waste air can be supplied through suitable air guiding devices directly to the blowers 88, and an admixture of fresh air, available from outside the sheet-fed printing press 10, is possible in the desired mixture ratio, or in other words from 0 to 100% depending upon requirements.

The individual segments and components, respectively, of a guide surface member 32 may, for example, be constructed with standardized dimensions, to allow for easy replaceability and adaptation to a given intended use without difficulty. In particular, a replacement of individual guide surface members 32 in a sheet-fed printing press 10 can be effected, for example, if because of the material to be processed or, in other words, the sheets 30, a different construction of the guide surface members becomes necessary, for example, a construction which has or does not have inlet and/or outlet zones 66 and 70, respectively. Conversion of the printing press 10 to the new requirements can thus be effected within the shortest possible time. Details of the mechanical fastening of the guide surface members 32 to the printing press 10 and the joining together of the individual segments of a guide surface member 32 will not be discussed herein in detail as they are not within the scope of the invention.

As is readily apparent from FIG. 17, viewing windows 90 can be assigned to the individual guide surface members 32, especially at the critical transitions thereof from or to a guiding device, observation of the guiding effect of the guide surface members 32 being possible through these windows. A control station 92 is assigned to each of the viewing windows 90, by means of which a variation of the air delivery to the guide surface member 32 or air guidance by the guide surface member 32 itself is possible. By way of the control stations 92, the flow parameters of the delivered air, for example, can be varied, it being unimportant, in this regard, whether a central blower 40 (FIG. 1) or decentralized blowers 88 are provided. For example, an adjustment of the nozzle pilot pressure, volumetric flow, and/or the air flow velocity can be effected. Moreover, throttle elements can be assigned to the guide surface members 32 or to the individual segments of the guide surface members 32, the throttles being disposed in the supply lines to the guide surface members 32 or directly in the guide surface members. Thereby, a mutually independent influence can be exerted upon the flow parameters of individual guide surface members 32 or individual segments of the guide surface members 32. In the disposition of decentralized blowers 88, the rotary speed of the blower can, for example, be adjusted so that influence can be exerted upon the flow parameters. By the decentralized adjustment of individual flow parameters, feedback-free adjustment to other guide surface members 32 becomes possible. Overall, the entire sheet-fed printing press 10 can thus be adjusted optimally to the machine speed being used, the type of paper or weight of the sheets 30, and/or various sizes or formats of the sheets 30. The adjustment can be performed either manually at the control stations 92 or automatically via a central electronic control system. With the aid of the control stations 92, readjustment of individual regions, i.e., of individual guide surface members 32 or individual segments of the guide surface members 32, can then be effected.

Overall, as a result of the constructions shown in FIGS. 1 to 17, it becomes possible to guide sheets 30 through the entire sheet-fed printing press 10 in a contactless manner. If parameters vary, problem-free adaptation of the guidance can be effected, so that contactless guidance which is independent, for example, of the machine speed, paper size and/or paper weight can be assured or established at any time.

We claim:

1. Device for contactless guidance of sheetlike material being dragged along a travel path, comprising a guide surface member extending spaced from the travel path and being provided with air-blowing nozzles, said guide surface member having first and second side edges and a guide zone formed between said first and second side edges the air-blowing nozzles within said guide zone being disposed in a manner that a common flow pattern formed during guidance of the sheetlike material is determined essentially by a first velocity component in a direction of motion of the material along the travel path, by a second velocity component directed towards said first side edge, and a third velocity component directed towards said second side edge.

2. Device according to claim 1, wherein said second and said third velocity components, respectively, are directed symmetrically to said side edges.

3. Device according to claim 1, wherein the guide surface member is formed entirely of said guide zone.

4. Device according to claim 1, wherein an air flow issuing from said air-blowing nozzles flares in a trumpetlike manner in the sheet travel direction.

5. Device according to claim 1, wherein the air-blowing nozzles are disposed in said guide zone in rows offset from one another, transversely to the sheet travel direction.

6. Device according to claim 5, wherein each of said air-blowing nozzles defines an air-flow with a divergence region bounded by edges, wherein the edges of air streams issuing from mutually adjacent air-blowing nozzles intersect at an intersecting location downstream from a row of nozzles including said mutually adjacent air-blowing nozzles, and wherein the air-blowing nozzles of a downstream row thereof, as viewed in the sheet travel direction, are disposed relative to the intersecting location.

7. Device according to claim 6, wherein the air-blowing nozzles are disposed downstream from the intersecting location, as viewed in the sheet travel direction.

8. Device according to claim 6, wherein the air-blowing nozzles are disposed upstream from the intersecting location, as viewed in the sheet travel direction.

9. Device according to claim 8, wherein the distance from the intersecting location is at most equal to half the distance by which said mutually adjacent air-blowing nozzles are spaced apart from one another.

10. Device according to claim 6, wherein the air-blowing nozzles are disposed at the intersecting location.

11. Device according to claim 5, wherein the air-blowing nozzles in the guide zone are formed of first air-blowing nozzles and second air-blowing nozzles, said first air-blowing nozzles being disposed on a center line of the guide surface member extending in the sheet travel direction, so as to direct blown air streams substantially in the sheet travel direction, and said second air-blowing nozzles being disposed in rows offset from one another, extending transversely to the sheet travel direction, so as to direct blown air streams symmetrically to said side edges of the guide surface member.

12. Device according to claim 11, wherein said blown air streams of said second air-blowing nozzles are directed at an angle of between 0° and 90° with respect to the sheet travel direction, symmetrically towards the side edges of the guide surface member.

13. Device according to claim 12, wherein said blown air streams of said second air-blowing nozzles are directed towards a gap formed by two of said second air-blowing nozzles disposed downstream in the blowing direction.

14. Device according to claim 12, wherein said blown air streams of said second air-blowing nozzles are directed substantially towards an air-blowing nozzles disposed downstream in the blowing direction.

15. Device according to claim 14, wherein said air-blowing nozzles are disposed in a pyramidlike pattern on the guide surface member as seen in a plan view.

16. Device according to claim 12, wherein said blown air streams of said second air-blowing nozzles are directed substantially towards a second air-blowing nozzles disposed downstream in the blowing direction in a row next-but-one thereto.

17. Device according to claim 12, wherein said blown air streams of said second air-blowing nozzles are directed substantially transversely to the sheet travel direction.

18. Device according to claim 1, wherein the guide surface member is formed with an inlet zone preceding the guide zone in the sheet travel direction.

19. Device according to claim 18, including an outlet zone downstream of the inlet zone.

20. Device according to claim 19, wherein said inlet zone and said outlet zone, respectively, have a rounded portion directed away from the travel path of the material.

21. Device according to claim 18, wherein said inlet zone is provided with at least one row of air-blowing nozzles acting counter to the sheet travel direction.

22. Device according to claim 18, wherein said inlet zone has a rounded portion directed away from the travel path of the material.

23. Device according to claim 18, wherein said outlet zone precedes at least one air-blowing nozzles blowing transversely to the sheet.

24. Device according to claim 1, wherein the guide surface member is formed with an outlet zone succeeding the guide zone in the sheet travel direction.

25. Device according to claim 24, wherein said outlet zone is provided with at least one row of air-blowing nozzles acting transversely to the sheet travel direction.

26. Device according to claim 25, wherein said air-blowing nozzles act symmetrically transversely to the sheet travel direction.

27. Device according to claim 24, wherein said outlet zone has a rounded portion directed away from the travel path of the material.

28. Device according to claim 1, wherein the guide surface member is formed of at least two sections, each of which has a guide zone, an inlet zone, and/or an outlet zone.

29. Device according to claim 28, wherein said inlet zone of the guide surface member is formed with recesses at a front end thereof for grippers of a material dragging device.

30. Device according to claim 1, including means for supplying blowing air to the guide surface members via a central blower.

31. Device according to claim, including means for supplying blowing air to the guide surface members via a decentralized blower.

32. Device according to claim 1, wherein the guide surface member have at least one of viewing windows and control stations assigned thereto, by means of which observation and adjustment, respectively of a guiding effect of the guide surface members is performable.

33. Device according to claim 32, wherein said viewing windows are disposed in transition regions of the guide surface members.

34. Device according to claim 32, including means for exerting influence by way of the control stations upon flow parameters of guiding air furnished by blowers.

* * * * *